US005730366A

United States Patent [19]

DeWitt

[11] Patent Number: 5,730,366

[45] Date of Patent: Mar. 24, 1998

[54] OSCILLATING, TRANSVERSE-AXIS WATER SPRINKLER WITH SEE-SAW SPRAY ARM AND TWIST-POSITIONABLE NOZZLES

[76] Inventor: Robert E. DeWitt, 49 Sherwick Rd., Oswego, Ill. 60543

[21] Appl. No.: 628,151

[22] Filed: Apr. 4, 1996

[51] Int. Cl.[6] ..... B05B 3/16

[52] U.S. Cl. ..... 239/242; 239/239; 239/602

[58] Field of Search ..... 239/DIG. 1, 229, 239/237, 239, 240, 241, 242, 263, 276, 381, 548, 566, 567, 602

[56] References Cited

U.S. PATENT DOCUMENTS

| | | | |
|---|---|---|---|
| 1,751,640 | 3/1930 | Lindhorst | 239/239 |
| 1,751,641 | 3/1930 | Lindhorst | 239/239 |
| 2,952,413 | 9/1960 | Jepson | 239/242 |
| 3,498,543 | 3/1970 | Gilmour | 239/242 |
| 3,559,888 | 2/1971 | Miklos | 239/242 |
| 4,245,786 | 1/1981 | Abrahamsen et al. | 239/242 |

*Primary Examiner*—Andres Kashnikow
*Assistant Examiner*—Steven J. Ganey
*Attorney, Agent, or Firm*—Brinks Hofer Gilson & Lione

[57] ABSTRACT

A water sprinkler of a new type has a spray arm which oscillates about a horizontal axis transverse or perpendicular to the length of the spray arm, in a see-saw fashion, to distribute water to a length of the lawn or garden area. Spray nozzles spaced apart on a distortable, peripheral wall along the length of the spray arm in a linear array are adjustable, by twisting the peripheral wall of the arm, to a circumferentially-arrayed, helical or spiral pattern, to distribute water to cover a selected width of the lawn or garden area. Both the angle of the oscillation and the twist of the wall may be selectively varied or adjusted to select respectively the length and the width of the area to be sprinkled. The twist is adjustably-fixed along and about the flow passage, as by an internal twist-setting arm. Also, the spray arm may oscillate about its center or one end thereof, depending on the oscillation mechanism used.

11 Claims, 1 Drawing Sheet

OSCILLATING, TRANSVERSE-AXIS WATER SPRINKLER WITH SEE-SAW SPRAY ARM AND TWIST-POSITIONABLE NOZZLES

BACKGROUND OF THE INVENTION

1. Field of the Invention

The present invention relates to water sprinklers. It is of a new type, having its spray arm oscillate on a transverse, horizontal axis perpendicular to its length and its spray nozzles adjustable helically by twisting the wall carrying them.

2. Description of the Prior Art

Water sprinklers for lawn and garden areas form a well developed art. Many details of construction useful to the present invention are known from and shown in the prior art. Oscillating wave sprinklers are well known in U.S. Pat. No. 3,498,543, having spray arms which oscillate on a horizontal axis parallel to the length of the spray arm. Some wave spray arms, as in that patent, are adjustable in arc to vary the width of the pattern, accomplished by bending the arm along its length. Vertical axis oscillating and rotary sprinklers also are known, as described for instance in my prior U.S. Pat. Nos. 4,180,210, 4,269,354, and 4,281,793. Such mechanisms are relatively complex to build and to use.

SUMMARY OF THE INVENTION

The present invention departs from the principles of prior art lawn and garden sprinklers and provides a transverse-axis action, in a see-saw like action, of a spray arm with twistably positionable nozzles on the length thereof. The angle of the oscillation of the spray arm, about a horizontal axis perpendicular to the length of the spray arm, controls the length of the area sprinkled, and the angle of twist of the nozzles along the arm controls the width of the area sprinkled. Any simple oscillation mechanism is used to impart the oscillation action to the spray arm.

THE PREFERRED EMBODIMENTS

Figure 1:
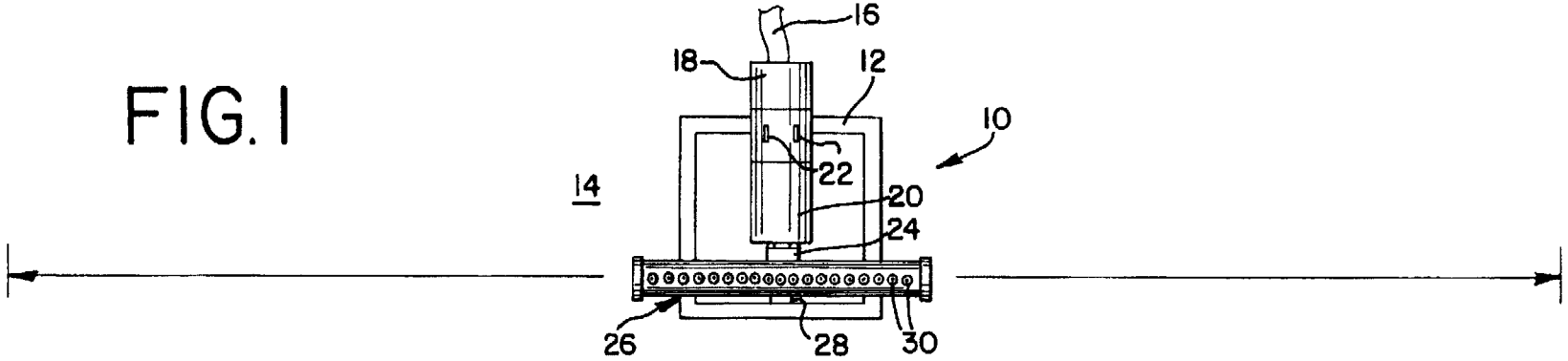
FIG. 1 is a top plan view of the lawn and garden sprinkler of the present invention, with the length of the water spray pattern in each direction indicated by the arrows.
Figure 3:
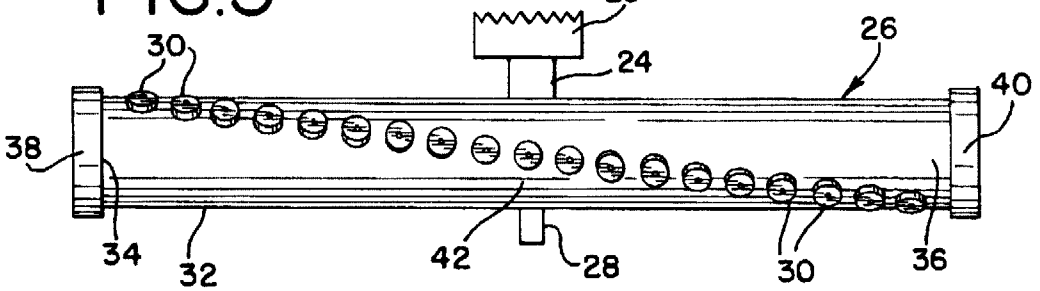
FIG. 3 is a plan view of the upper part of the spray arm of the water sprinkler of FIGS. 1 and 2, with the peripheral wall twisted uniformly to distribute water to a selected width of a lawn or garden area.
Figure 2:
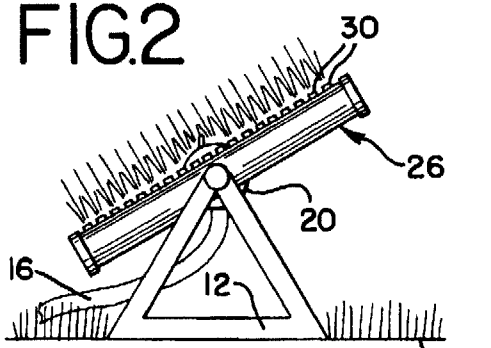
FIG. 2 is a side elevational view of the sprinkler in one oscillational position of the spray arm.

The lawn and garden sprinkler 10 of the present invention is shown in one embodiment in FIGS. 1–3. A base 12 positions and stabilizes the sprinkler 10 at the center of a ground surface area 14 to be watered. A water hose 16 supplies a desired volume of pressurized water to the sprinkler 10 through a housing 18 and an oscillator mechanism 20 of any conventional or desired type, containing gears, impellers, and/or cams in the flow path of the water or any other appropriate devices. Adjustable control tabs 22 on the housing 18 limit the maximum oscillation of the mechanism 20 as an operator may desire. An integral water flow passage 24 of the oscillator 20 carries water into the spray arm 26, and a bearing surface 28 opposite the flow passage 24 supports and stabilizes the spray arm 26 in a bearing (not shown) in the ground support base 12. Any appropriate water-tight coupling of the flow passages between the moving parts and the non-moving parts may be used.

The spray arm 26 of the sprinkler 10 oscillates with the mechanism 20 adjacent the housing 18. The spray arm 26 has a single row of spray nozzles 30 carried in and on and arranged along a cylindric peripheral wall 32 of the spray arm. The nozzles 30 communicate through an interior flow passage formed within the wall 32 and a further passage therein to the internal flow passage 26 from the oscillator 20 and hose 16.

Figure 4:
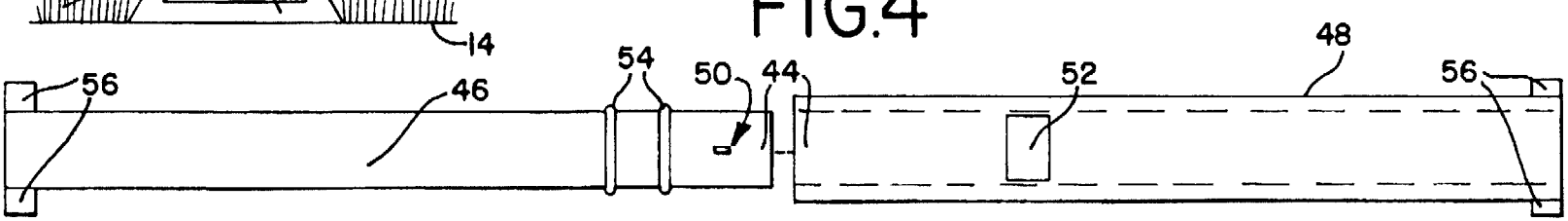
FIG. 4 is a plan view of an internal mechanism for selectively setting and maintaining the twist of the peripheral wall of, and the nozzles on, the spray arm.

The peripheral wall 32 of the spray arm is distortable and preferably resilient, being made for instance of a hose-like, reinforced synthetic rubber material. The spray nozzles 30 are molded integrally with the wall 32 or may be separately formed and the side walls crimped in water-tight fashion to the wall. The nozzles 30 communicate water through the wall 32 in desired streams. The nozzles are arrayed first in a generally linear row on the untwisted wall 32, as shown in FIGS. 1 and 2. Ends 34, 36 of the wall 32 have mounted thereon screw-on, water-tight end caps 38, 40, as shown in FIG. 4.

The end caps 38, 40 and the end portions 34, 36 of the wall 30 can be twisted in opposite directions with respect to a longitudinally central portion 42 of the spray arm 26 in this embodiment, to impart a helical, spiral or similar twist to the row of nozzles. An overall angle of up to about 60° between the nozzles 30 adjacent the two end caps 38, 40 is preferably provided.

A suitable releasable twist control device, friction or locking, is used to select and maintain a twist in the distortable wall 32 against the resiliency of the wall itself. One such system is shown in FIG. 4.

In this adjustment system, a central rod or tube member 44 extends from one end 34 of the spray arm 26 to the other end 36. The central member 44 has two parts 46, 48 which interfit within the spray arm 26 and are adjustable with respect to each other in angle. A detent bump 50 on the smaller part 46 passes within the larger part 48 and into a window opening 52 in that larger part. The window 52 has a circumferential arc of 60° sufficient to allow angular adjustment of the two parts with respect to each other. O-rings 54, formed of a suitable rubber-like material, are retained on the outer surface of the smaller part 46; they provide sufficient friction with the inner surface of the larger part 48 to retain the parts 46 and 48 in desired angular adjustment during setup and operation of the sprinkler 10. The outer ends of the central member 44 have laterally-extending tongues 56 which fit into slots (not shown) formed in the inner surfaces of the ends 34, 36 of the spray arm wall 32.

Once the end caps 38, 40 are screwed onto the ends of the spray arm 26 with the central member 44 inside, a user's manual twisting of the ends of the spray arm wall 32, to set a desired twist and thus a width of the water spray pattern, will be retained by the friction forces acting between the parts 46, 48 of the central member 44 acting between the ends 34, 36 of the wall 32 via the tongues 56. No disassembly of the end caps is normally required for twist adjustment. Because the wall 32 is of resilient material, the twist will be uniformly distributed along the length of the wall, so the water spray pattern will also be uniform over the lawn or garden to be sprinkled.

In operation of this embodiment, a garden hose 16 is connected to the sprinkler 10. The adjustment tabs 22 are set to control the length of the pattern to be sprinkled upon see-saw motion of the oscillation mechanism 20 and its spray arm 26. The end caps 38, 40 and ends 34, 36 of the spray arm are twisted manually with respect to the center portion 42 to set the width of the pattern. The sprinkler is preferably used at full water volume flow and pressure to minimize sprinkling time and evaporation losses, subject to water run-off concerns. The oscillator 20 causes the spray arm 26 to move up and down at either end, in a see-saw fashion, covering both the length and width of the spray pattern desired.

In alternative embodiments, the spray arm 26 may be pivoted on a horizontal axis located other than at the longitudinal center. For instance, the supply water line 16 may communicate directly into one end of the spray arm and the other end of the spray arm be continuously raised and lowered, such as by a unidirectionally-rotating cam, to effect oscillation of the spray arm and distribution of water over the length of the lawn or garden area. This and other variations may be advantageously incorporated into a sprinkler without departing from the principles of this invention. Other adaptations may be made by those of ordinary skill in the art once the invention is understood and appreciated, still without departing from the invention disclosed and claimed herein.

I claim:

1. A transverse axis water sprinkler for a lawn or garden area, the sprinkler comprising:

a spray arm that is generally straight and extends along a longitudinal axis between ends thereof, the spray arm having a longitudinal water flow passage extending generally along said axis and enclosed by a peripheral wall and at least one end cap;

a plurality of spray nozzles spaced apart along the peripheral wall of the spray arm generally from one said end to the other, each said nozzle communicating from the flow passage through the peripheral wall to an exterior thereof and in a direction generally perpendicular to the longitudinal axis of the spray arm;

a connection for pressurized water to the water flow passage of the spray arm; and a movement mechanism which causes the spray arm to oscillate about a horizontal axis extending perpendicular to the longitudinal axis of the spray arm, whereby pressurized water flowing through the water inlet will be distributed generally evenly upon a selected length and width of said lawn or garden area by oscillation of the spray nozzles on the spray arm about the horizontal axis.

2. A transverse axis water sprinkler as defined in claim 1, wherein said movement mechanism includes means for adjusting the angle of oscillation of the spray arm to distribute water area over a selected greater and lessor length of said lawn or garden area.

3. A water sprinkler as defined in claim 2, wherein the movement mechanism tilts the spray arm from approximately the center of the length of said spray arm, in see-saw fashion.

4. A water sprinkler as defined in claim 1, wherein the peripheral walls of the spray arm carrying the spray nozzles are comprised of a readily distortable material, whereby selected twisting of the peripheral walls about the longitudinal axis displaces the spray nozzles circumferentially to distribute water over a greater or lessor width of said lawn or garden area.

5. A water sprinkler as defined in claim 4, wherein the distortable material is resilient and the ends of the spray arm are selectively fixed with a selected twist with respect to another portion of the peripheral wall.

6. A water sprinkler as defined in claim 5, wherein said other portion of the peripheral wall is adjacent the water inlet to the spray arm.

7. A water sprinkler as defined in claim 5, wherein said other portion of the peripheral wall is adjacent a center of the length of the spray arm.

8. A water sprinkler as defined in claim 5, further comprising a twist retention member within the spray arm, the member comprising a pair of parts each engaging one or the other end of the spray arm and a connection means acting between the parts for retaining a selected rotational displacement between them.

9. A water sprinkler as defined in claim 8, wherein the connection means comprises at least two O-rings interposed frictionally between cooperating surfaces of the first and second parts.

10. A transverse-axis water sprinkler for a lawn or garden area, the sprinkler comprising:

a ground support base;

a housing and an oscillator means supported on the base;

an inlet for a flow of pressurized water to the housing and oscillator means;

a spray arm carried on the oscillator means and having a peripheral wall and an internal water flow passage communicating with said water flow inlet; and a plurality of spray nozzles carried in a row on the peripheral wall of the spray arm and communicating with the flow passage;

wherein the peripheral wall of the spray arm is formed of a resilient material able to be selectively set with a twist about its longitudinal axis to impart a helical or spiral form to said row of spray nozzles thereon, whereby when the spray arm is oscillated in see-saw fashion a length of said lawn or garden area is sprinkled with said water over time and the twist in the row of spray nozzles sprinkles water over a width thereof in the same time.

11. A water sprinkler as defined in claim 10, further comprising a twist control device in the spray arm, the control device comprising:

a two-piece member extending from one end of the spray arm to the other and engaging the ends of the peripheral walls of the spray arm;

a first piece of the member engaging a second piece of said rod in a rotationally-adjustable friction fitting between them, wherein the friction force imparted between the pieces of the member by the friction fitting is greater than the opposing twisting force of the peripheral wall of the spray arm even in operation under water pressure and other forces.

* * * * *